US006168024B1

(12) United States Patent
Coates et al.

(10) Patent No.: US 6,168,024 B1
(45) Date of Patent: Jan. 2, 2001

(54) COSMETIC PENCIL AND CASE

(75) Inventors: Thomas Jefferson Coates; Robert Nathan Brown, both of New York, NY (US)

(73) Assignee: Revlon Consumer Products Corporation, New York, NY (US)

( * ) Notice: Under 35 U.S.C. 154(b), the term of this patent shall be extended for 0 days.

(21) Appl. No.: 09/421,882

(22) Filed: Oct. 21, 1999

(51) Int. Cl.[7] ..... A45D 40/20
(52) U.S. Cl. ..... 206/581; 132/318; 401/88
(58) Field of Search ..... 206/581, 823, 206/306, 385, 446, 37, 38, 497, 807, 45.2; 132/137, 318, 320, 333; 401/49, 52, 88, 195

(56) References Cited

U.S. PATENT DOCUMENTS 3,283,894 * 11/1966 Hafner et al. ..... 206/306
4,326,546 * 4/1982 Acker ..... 206/581
4,562,923 * 1/1986 Katada et al. ..... 206/581
4,987,911 * 1/1991 Powers ..... 132/320
5,301,808 * 4/1994 Pierson ..... 206/581
6,035,866 * 3/2000 Seneco et al. ..... 132/318

* cited by examiner

*Primary Examiner*—Luan K. Bui
(74) *Attorney, Agent, or Firm*—Julie Blackburn

(57) ABSTRACT

A cosmetic pencil case for housing a cosmetic pencil having a cap thereon, comprising an elongated hollow body having a bottom end and an open top end, the bottom end having an outer surface which forms the external, bottom surface of the elongated hollow body, and an inner surface, a removable stopper affixed to the top end of said hollow body forming a cover, said stopper having an outer surface which forms the external top surface of the elongated hollow body, and an inner surface containing a recessed cavity of a size and shape to accommodate the cap of the cosmetic pencil in a friction fit; as well as the cosmetic pencil in combination with the case.

16 Claims, 2 Drawing Sheets

COSMETIC PENCIL AND CASE

TECHNICAL FIELD

The invention is in the field of cosmetic pencils and storage receptacles for cosmetic pencils.

BACKGROUND OF THE INVENTION

Cosmetic pencils are widely used by professional makeup artists as well as at-home consumers who wish to apply color to the skin in a more controllable manner. Most often cosmetic pencils are used for drawing lines around the lips and eyes, as well as to touch up blemishes or skin irregularities with a skin-matching color. Cosmetic pencils are most often sold with cylindrical plastic lid that friction fits over the pencil to cover the tip. While this type of presentation is adequate, it doesn't deter from testing of the pencil in the store by customers, nor does it facilitate storage of the pencil by the consumer when not in use. Accordingly, there is a desire for a better method of storing cosmetic pencils as well as deterring tampering with the pencil prior to purchase.

It is an object of the invention to provide a cosmetic pencil and case wherein the case acts as a stable storage receptacle for the cosmetic pencil when it is not in use.

It is another object of the invention to provide a cosmetic pencil and case with improved tamperproof characteristics.

It is another object of the invention to provide a cosmetic pencil and case exhibiting improved aesthetics where the pencil appears to "float" within the case.

SUMMARY OF THE INVENTION

The invention comprises a cosmetic pencil case for housing a cosmetic pencil having a cap thereon, comprising, in combination:

(a) an elongated hollow body having a bottom end and an open top end, (b) the bottom end of said hollow body having an outer surface which forms the external, bottom surface of the elongated hollow body, and an inner surface containing a recessed cavity of a size and shape to accommodate the base of the cosmetic pencil in a friction fit, (c) a removable stopper affixed to the top end of said hollow body forming a cover, said stopper having an outer surface which forms the external top surface of the elongated hollow body, and an inner surface containing a recessed cavity of a size and shape to accommodate the cap of the cosmetic pencil in a friction fit.

The invention further comprises a cosmetic pencil and pencil case, comprising, in combination:

(a) an elongated hollow body having a bottom end and an open top end, and a cosmetic pencil having a base, a tip, and a cap thereon, housed within the elongated hollow body, (b) the bottom end of said hollow body having an outer surface which forms the external, bottom surface of the elongated hollow body, and an inner surface, (c) a removable stopper affixed to the top end of said hollow body forming a cover, said stopper having an outer surface which forms the external top surface of the elongated hollow body, and an inner surface containing a recessed cavity of a size and shape to accommodate the cap of the cosmetic pencil in a friction fit.

The invention further comprises a cosmetic pencil and pencil case comprising, in combination:

(a) an elongated hollow body having a bottom end and an open top end, and a cosmetic pencil having a base, a tip, and a cap thereon, housed within the elongated hollow body, (b) the bottom end of said hollow body having an outer surface which forms the external, bottom surface of the elongated hollow body, and an inner surface containing a recessed cavity of a size and shape to accommodate the base of the cosmetic pencil in a friction fit, (c) a removable stopper affixed to the top end of said hollow body forming a cover, said stopper having an outer surface which forms the external top surface of the elongated hollow body, and an inner surface having permanently affixed thereto a cap for the cosmetic pencil.

DETAILED DESCRIPTION OF THE DRAWINGS

Figure 1:
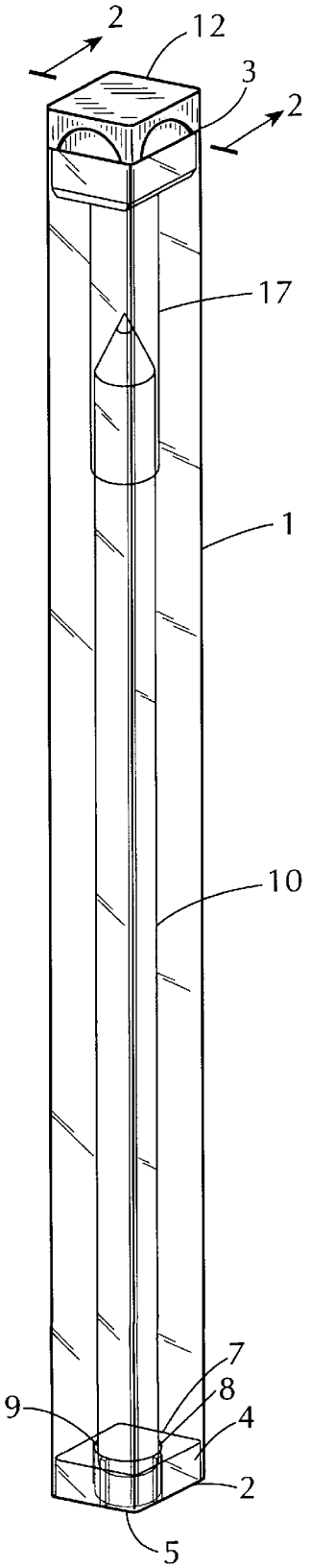
FIG. 1: is a perspective view of the cosmetic pencil having the cap thereon, housed within the cosmetic pencil case, in the preferred embodiment of the invention.
Figure 2:
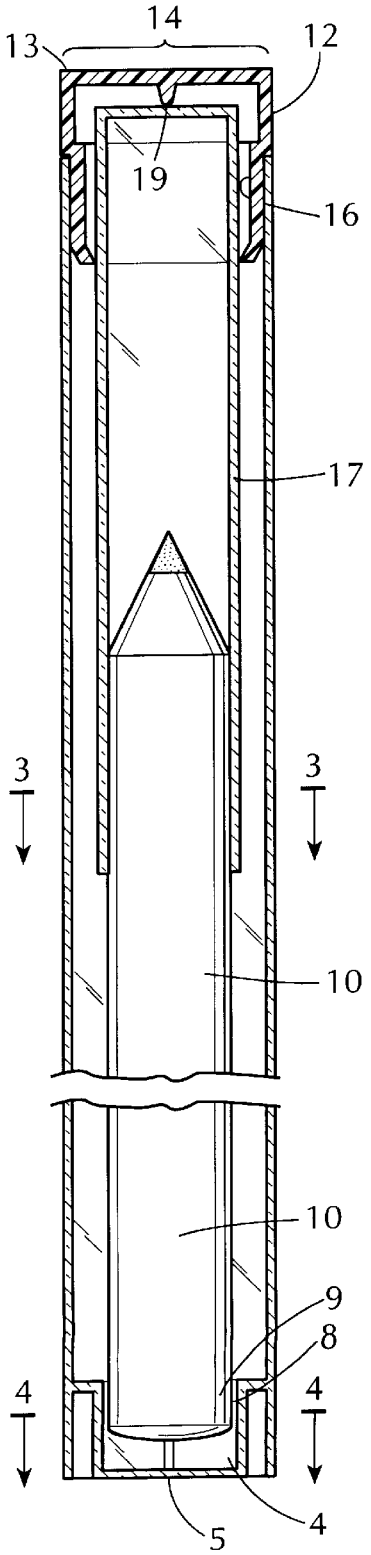
FIG. 2: is a cross sectional view taken across 2—2 of FIG. 1.
Figure 3:
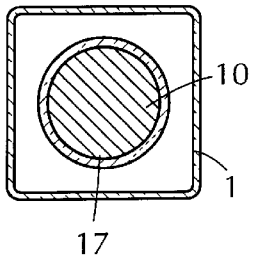
FIG. 3: is a cross-sectional view taken across 3—3 of FIG. 2.
Figure 4:
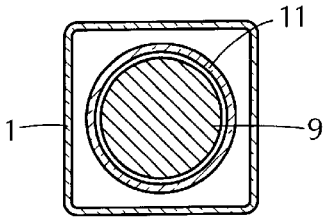
FIG. 4: is a cross-sectional view taken across 4—4 of FIG. 2.
Figure 6:
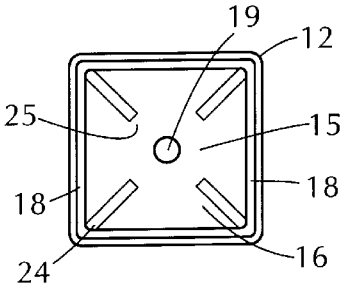
FIG. 6: illustrates the inner surface of the stopper affixed to the top end of the elongated hollow body, showing the protrusion and plurality of splines.
Figure 7:
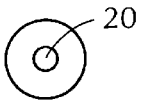
FIG. 7: illustrates the top surface of the cosmetic pencil cap, showing the slight indentation designed to fit with the protrusion on the inner surface of the stopper.

FIG. 1 is a perspective view of the cosmetic pencil and case of the invention which comprises an elongated, hollow body 1 having a bottom end 2 and open top 3 end. The elongated hollow body 1 illustrated in the Figures is square in circumference, however, the elongated hollow body 1 may be cylindrical, cone shaped, or even have varying widths throughout the length, if desired. The bottom end 2 may be closed by stamp forming the end according to methods well known in the art. For example, stamp forming may be accomplished by solvent sealing a piece of synthetic thermoplastic material to the bottom end 2 of the elongated hollow body 1. The bottom end 2 may also be closed by means of a stopper 4. The stopper 4 has an outer surface 5 that forms the external, bottom surface 6 of the elongated hollow body 1. The stopper 4 has an inner surface 7. Preferably, the stopper 4 contains a recessed cavity 8 of a size and shape to accommodate the base 9 of the cosmetic pencil 10 in a friction fit. The term "friction fit" means that the base 9 of the cosmetic pencil 10 is snugly held in the recessed cavity 8 by the close proximity of the cosmetic pencil base 9 to the side walls 11 of the recessed cavity 8. Generally, friction fit is accomplished by making the recessed cavity 8 slightly smaller in circumference than the cosmetic pencil base 9 such that when the cosmetic pencil base 9 is squeezed into the recessed cavity 8, the side walls of the recessed cavity 8 are capable of slightly expanding to accommodate the cosmetic pencil base 9. The size and shape of the recessed cavity 8 will be determined by the circumference of the cosmetic pencil base 9. For example, if the cosmetic pencil 10 is in the cylindrical form, the recessed cavity 8 will be round in circumference so as to be capable of friction fitting with the cosmetic pencil 10 base 9. However some cosmetic pencils are square, or have other circumferential shapes. In this case, the recessed cavity 8 may be squarely shaped, or shaped in whatever configuration will friction fit with the cosmetic pencil. Preferably, the recessed cavity 8 is centered in the stopper 4.

Figure 5:
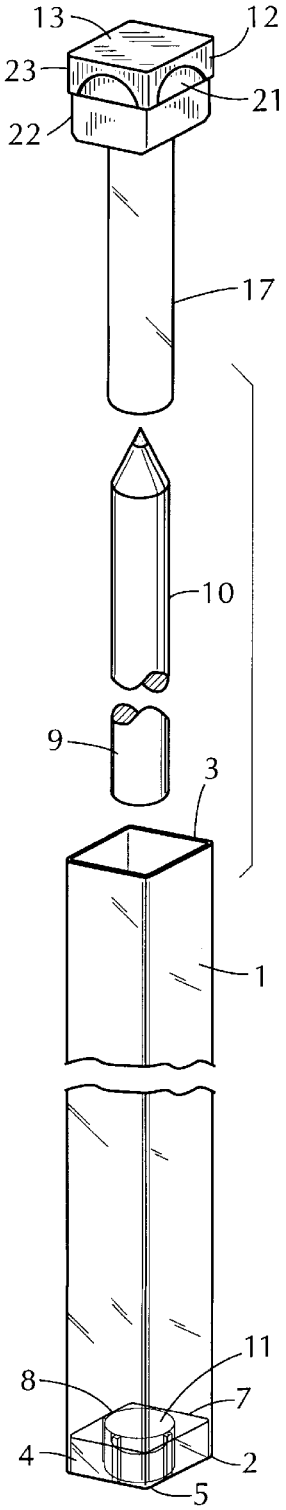
FIG. 5: is a an exploded view of the cosmetic pencil and case depicted in FIG. 1 wherein both a portion of the pencil and a portion of the elongated body have been omitted.

The open top end 3 of the elongated hollow body 1 has a removable stopper 12 affixed thereto. FIG. 5 illustrates how the removable stopper 12 is removed from the open top end 3 of the elongated hollow body 1. The stopper 12 has an outer surface 13 which forms the external, top surface 14 of the elongated hollow body 1. In the preferred embodiment of the invention, the stopper 12 has an inner surface 15 containing a recessed cavity 16 having a plurality of splines 24 which extend from the sidewalls 18 of the stopper 12 inner surface 15, having ends 25 that converge in the central area of the recessed cavity. There is enough space between the ends 25 to accommodate the cap 17 of the cosmetic pencil 10 in a friction fit, e.g. the splines 24 are situated such that the spline ends 25 exert a sufficient pressure on the cap 17 when the cap is placed therebetween to keep the cap anchored within the space between the spline ends 25. The cap 17 is removable from the stopper 12. In the preferred embodiment of the invention the recessed cavity 16 found on the inner surface 15 of the stopper 12 is square in shape, and the ends of the plurality of splines 24 which converge in the center of the recessed cavity are capable of friction fitting with the cap 17 of the cosmetic pencil 10 because the circumference of the cap 17 is slightly larger than the space between the ends 25 of the plurality of splines 24. At least three or four splines are required to properly anchor the cap, but more splines may be desired. The recessed cavity 16 found on the inner surface 15 of the stopper 12 may have a protrusion 19 that projects upwardly, in the center of the space formed by the ends 25 of the converging splines 24. Similarly, if desired, the cap 17 may have a small indentation or depression 20 of a size and shape sufficient to mate with the protrusion 19 and thereby further anchor the cap 17 in the recessed cavity 16. While, in the preferred embodiment of the invention, the recessed cavity 16 of the stopper 12 is square in shape, it could be circular as well, or in any other size or shape that would enable some type of friction fit with the cap 17 found on the cosmetic pencil 10. In another embodiment of the invention, the cap 17 is not removable from the stopper 12, and the cap 17 and the stopper 12 are molded as one piece. This is best illustrated in FIG. 5.

If desired, the stopper 12 may contain one or more slight indentations 21 to facilitate gripping and more easily facilitate removal. Preferably the stopper 12 has side walls that are graduated such that the side wall base 22 that friction fits with the top end 3 of the elongated hollow body 1 is slightly smaller in circumference than the top outer side wall 23 of the stopper.

The cosmetic pencil 10 may be made of various materials such as wood, synthetic thermoplastic materials such as polyethylene, or other materials. Typically, the cosmetic pencil 10 dispenses pigmented cosmetic material that may be used for lining eyes, lips, or touching up blemishes or skin irregularities. The cap 17 of the cosmetic pencil is preferably made of a synthetic, thermoplastic, polymeric material. Both the cap 17 and the stopper 12 may be opaquely colored, tinted, or clear. Preferably, the elongated hollow body 1 is tinted or clear and is made from a synthetic, thermoplastic polymeric material such as polyethylene, polystyrene, ABS. It may also be desirable that the cap 17 or the stopper 12 be made of a synthetic thermoplastic material that is the same color as the colored of the cosmetic pencil found therein, thus facilitating selection of the pencil by the purchaser and the user. The cap 17 is preferably cylindrical in shape, but can be other sizes and shapes as well, provided it friction fits onto the cosmetic pencil 10 over the tip 21.

Figure 8:
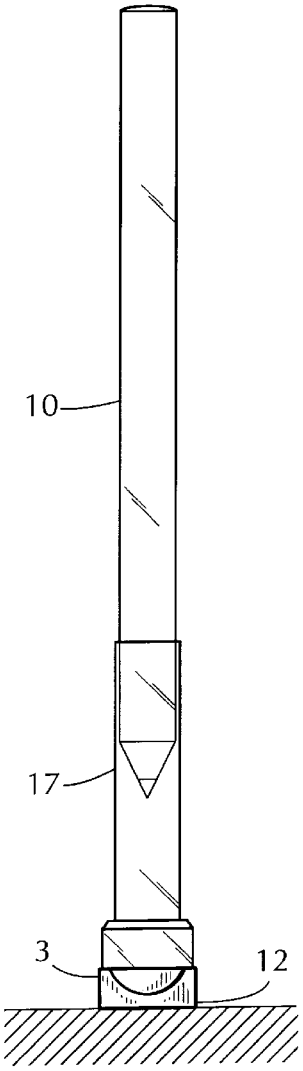
FIG. 8: illustrates the cosmetic pencil having the cap thereon affixed to the inner surface of the stopper, and removed from the elongated body, where the stopper serves as a base for anchoring the cosmetic pencil.

FIG. 8 illustrates how the stopper 12, when removed from the open top end 3 of the elongated hollow body 1, it may serve as a base for anchoring the cosmetic pencil 10 in a straight up position on a table, for example.

The cosmetic pencil and case of the invention can be adapted so that they are tamperproof, by simply placing a small patch of shrink-wrapped plastic around the junction between the stopper 12 and the elongated hollow body. The consumer who purchases the pencil removes the shrink wrapped plastic and is able to remove the stopper 12.

The cosmetic pencil and case also provides a unique visual appearance that is attractive to consumers because the cosmetic appears to float within the case.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A cosmetic pencil and a case for housing the cosmetic pencil comprising, in combination:

(a) an elongated hollow body having a bottom end and an open top end, and a cosmetic pencil having a base, a tip, and a cap thereon, housed within the elongated hollow body, (b) the bottom end of said hollow body having an outer surface which forms the external, bottom surface of the elongated hollow body, and an inner surface, (c) a removable stopper affixed to the top end of said hollow body forming a cover, said stopper having an outer surface which forms the external top surface of the elongated hollow body, and an inner surface containing a recessed cavity of a size and shape to secure the cap of the cosmetic pencil in a friction fit within the recessed cavity.

2. The cosmetic pencil and case of claim 1 wherein the elongated hollow body is square.

3. The cosmetic pencil and case of claim 1 wherein the elongated hollow body is made from a clear, thermoplastic, synthetic polymeric material.

4. The cosmetic pencil and case of claim 1 wherein the cosmetic pencil is cylindrical.

5. The cosmetic pencil and case of claim 4 wherein the cap on the cosmetic pencil which is secured in the recessed cavity, is a cylindrically shaped cover made from a clear, thermoplastic, synthetic polymeric material.

6. The cosmetic pencil and case of claim 1 wherein the bottom end is closed by a stopper affixed to the bottom end of the elongated hollow body, said stopper containing a recessed cavity of a size and shape to secure the base of the cosmetic pencil in a friction fit in the recessed cavity.

7. The cosmetic pencil and case of claim 6 wherein the stopper affixed to the bottom end of the hollow body is made of a clear, thermoplastic, synthetic polymeric material.

8. The cosmetic pencil and case of claim 6 wherein the recessed cavity in the stopper affixed to the bottom end of the hollow body is centered on the stopper inner surface.

9. The cosmetic pencil and case of claim 8 wherein the recessed cavity is circular.

10. The cosmetic pencil and case of claim 1 wherein the removable stopper affixed to the top end of said hollow body forming a cover is made from a pigmented synthetic, thermoplastic, polymeric material.

11. The cosmetic pencil and case of claim 1 wherein the recessed cavity on inner surface of the removable stopper affixed to the top end of said hollow body is square.

12. The cosmetic pencil and case of claim 11 wherein the inner surface of the recessed cavity contains a plurality of splines having ends that converge in the center of the cavity.

13. The cosmetic pencil and case of claim 11 wherein the distance between the ends of the splines is sufficient to secure the cap of the pencil in a friction fit between said splines.

14. The cosmetic pencil and case of claim 13 wherein the recessed cavity contains a protrusion in the center thereof, and the cap of the pencil contains a depression on the top surface thereof, wherein the protrusion in the recessed cavity fits into the depression on the top surface of the cap to further secure the cap in the recessed cavity.

15. The cosmetic pencil and case of claim 1 wherein when the removable stopper affixed to the top end of said hollow body forming a cover is removed from the elongated hollow body said cosmetic pencil and cap remain affixed to said stopper.

16. The cosmetic pencil and case of claim 15 wherein the outer surface of the removable stopper affixed to the top end of said hollow body forming a cover, when removed from the elongated body and having said cosmetic pencil and cap affixed to the inner surface thereof, serves as a base for holding said cosmetic pencil upright.

* * * * *